US006272695B1

(12) United States Patent
Brandner

(10) Patent No.: US 6,272,695 B1
(45) Date of Patent: Aug. 14, 2001

(54) COLLAPSIBLE DOME FOR POOLS

(76) Inventor: Aljaz Brandner, Kamniska 30 SI-2000, Maribor (SI)

( * ) Notice: Subject to any disclaimer, the term of this patent is extended or adjusted under 35 U.S.C. 154(b) by 0 days.

(21) Appl. No.: 09/583,083

(22) Filed: Aug. 10, 2000

Related U.S. Application Data

(63) Continuation-in-part of application No. 09/266,670, filed on Mar. 9, 1999, now abandoned.

(51) Int. Cl.[7] ..... E04H 4/06
(52) U.S. Cl. ..... 4/498
(58) Field of Search ..... 4/498, 503

(56) References Cited

U.S. PATENT DOCUMENTS 3,461,890 * 8/1969 Goodrich ..... 4/498 X
4,246,663 * 1/1981 Aragona et al. ..... 4/498 X
4,951,327 * 8/1990 Del Gorio ..... 4/503 X

FOREIGN PATENT DOCUMENTS

2675189 * 10/1992 (FR) ..... 4/498

* cited by examiner

*Primary Examiner*—Charles E. Phillips

(57) ABSTRACT

A collapsible dome includes two or more arches of larger radius than half of the diameter of the pool which are therefore lower and provide a consequently lower structure, preferably of arcuated shape. Arches are pivotably attached on one end to the first support base, mounted to the pool's edge, and on the other to the second support base. Second support base is slidably hung upon a support guide bar which is mounted on the pool's edge with one end opposite the first support base and a membrane cover attached to each arch and tensioned after set up to the pool's edge. While the membrane is not fastened to the pool's edge, one side of the collapsible dome can easily be shifted along the support guide bar. Before collapsing the dome, the second support base should be shifted along the support guide bar in the appropriate direction to decrease the circumference between the first and second support bases. The arches, having a larger radius than the pool, would otherwise collapse into the pool instead of onto the pool's edge. When the dome is used on pools with shape different than round like oval or rectangular, shifting of both support bases along the pool's edge before collapsing of the dome is required to assure collapsing of the dome on or behind the pool's edge. Domes having only two arches are quickly and easily attached to the pool's edge by pivotable attaching components, which include two cups into which the ends of the arches are put by means of slip joint assemblies, bound by a cord that permits pivotal movement to the base support.

8 Claims, 3 Drawing Sheets

COLLAPSIBLE DOME FOR POOLS

CROSS-REFERENCE TO RELATED APPLICATIONS

This is a continuation-in-part, of my application application Ser. No. 09/266,670, filed on Mar. 9, 1999 anbandoned.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates generally to collapsible domes and, more particularly, to a collapsible arch supported lightweight tension dome which is especially suitable for use on round shaped swimming pools.

The art abounds with many different types of portable and collapsible shelters used for many different purposes. A typical example of such shelters is disclosed in U.S. Pat. No. 3,905,908 which discloses a collapsible shelter whose height depends on the area covered and is therefore not suitable to cover larger round shaped pools.

BRIEF SUMMARY OF THE INVENTION

The prior art discussed above may be readily suitable for shelter from wind and rain, for use on the beach, camping facilities or terraces and the like. However, these structures, especially those above ground level, which when folded in a collapsed position should be placed around one side of a pool without having its parts in it, are not suitable for covering large, round shaped swimming pools. In order to be suitable, the prior art structures would have to have arches of the same radius as the pool, thereby attaining a height, which for optical and wind load reasons would be too high for larger round shaped pools. Although the height of prior art structures that do not have an arch in a vertical position can be lowered by increasing the roof section between the two most vertical inclined arches, this limited method is suitable only for smaller round shaped pools not exceeding cca. 12 feet due to the increasing roof load as well as for optical reasons.

The principal idea of this invention is to provide a means by which a lightweight, arch-supported, collapsible dome, designed for covering round shaped pools, can be shifted on one side or on both sides along the round shaped pool's edge before being collapsed, thereby making possible the use of the lower arches, resulting in a lower structure.

It is also an object of the present invention to provide a means for quick and easy pivotable attachment and detachment of the two-arch collapsible dome to the pool's edge.

The foregoing and other objects and advantages will appear from the description as follows.

In the description, reference is made to the accompanying drawing, which forms a part hereof and which is shown by way of illustration a preferred embodiment in which the invention may be practiced. The preferred embodiment will be described in sufficient detail to enable those skilled in the art to practice the invention and is to be understood that other embodiments may be utilized and that some changes may be made without departing from the spirit and scope of the present invention. The following detailed description is therefore, not to be taken in a limiting sense but the scope of invention is best defined by the appended claims.

DETAILED DESCRIPTION OF THE INVENTION

Figure 1:
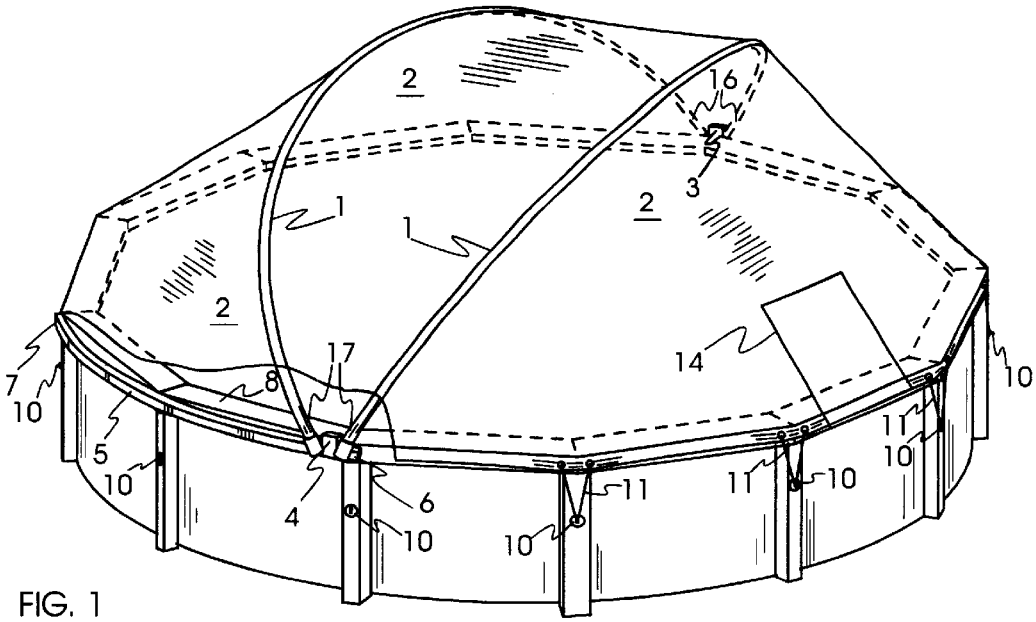
FIG. 1 is a perspective view of a collapsible dome of the present invention in an set up position

The collapsible structure shown in FIG. 1 is commonly referred to in this field as a lightweight arch-supported tension structure that has inclined arches 1 that are fastened to a membrane 2 which, when set up, is under tension to the degree that it acts as a rigid structural component. The flexible membrane 2 is preferably of clear PVC film, thereby providing a hot bed so that water is encompassed by heat in the day time and protected against the cold in the night.

Arches 1 of larger radius than half of the pool's diameter are thereby lower and provide consequently lower structure, preferably of arcuated shape and are pivotably attached on one end to the first base support 3, mounted on the pool's edge 8, and on the other to the second base support 4, which is slidably hung upon a support guide bar 5, mounted on the pool's edge 8 with the beginning 6 of the support guide bar 5 exactly opposite the support base 3 on the opposite side of the pool. The base support 4, whose inner end part 15 hangs upon the support guide bar 5, should be of hard plastic that allows sliding along the support guide bar 5 which is preferably made of aluminum.

Figure 3:
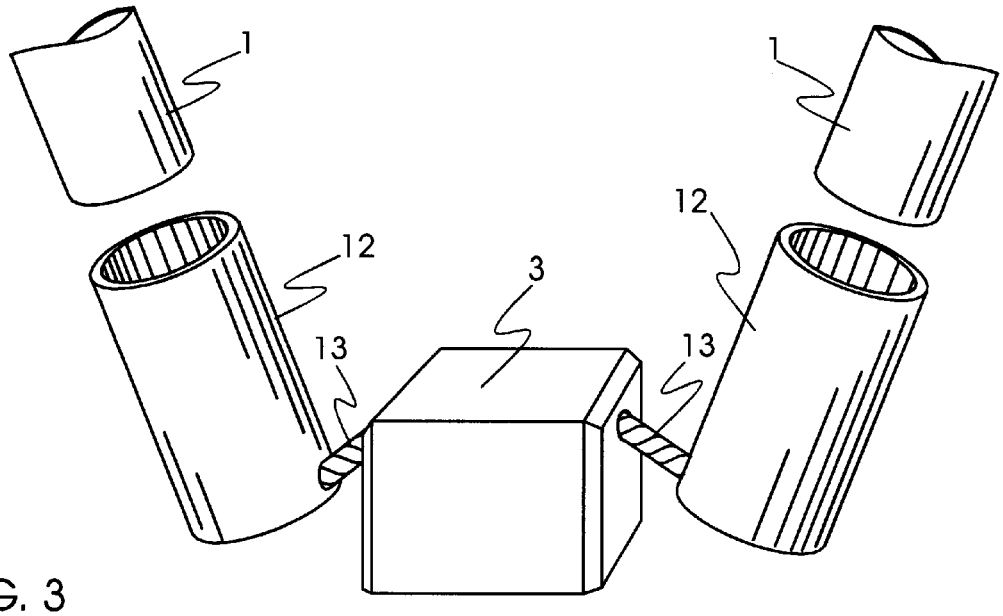
FIG. 3 is an enlarged perspective view of the pivotable attachment components on the first support base when the collapsible dome has two arches
Figure 4:
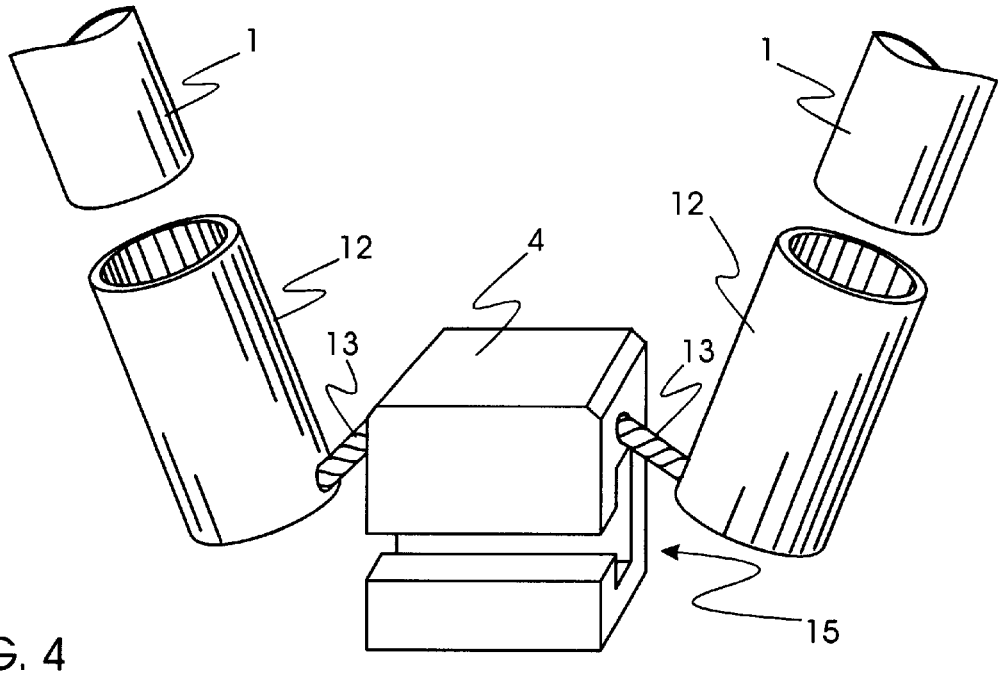
FIG. 4 is a rear and side enlarged perspective view of the pivotable attachment components on the second support base when the collapsible dome has two arches

For domes having two arches, the pivotable attachment components include two cups 12, into which the ends 16 of the arches 1 are put by means of slip joint assemblies, bound through a short cord 13 that permits pivotal movement thereof to a base support 3 as illustrated in FIG. 3 and two additional cups 12, into which the ends 17 of the arches are put by means of slip joint assemblies, bound through a short cord 13 that permits pivotal movement thereof to a base support 4 as illustrated in FIG. 4.

While the membrane 2 is not fastened to the pool's edge 8, one side of the collapsible lightweight dome can easily be shifted along the support guide bar 5.

Before collapsing, the second support base 4 should be moved from the set up position at the beginning 6 of the support guide bar 5 to the collapsing position at the end 7 of the support guide bar 5 . This is due to the arches 1, which, having a larger radius than the pool, would otherwise collapse into the pool instead of onto the pool's edge 8. The length of the support guide bar 5 is determined as the difference between the circumference of half the pool and the length of the arches 1. Although the arches 1 have been shown as being arcuate in shape, it will be obvious to those knowledgeable in the art that this is not a necessary requirement and that the shape may be varied in order to obtain a particular desired shape of the collapsible dome. In that respect, the length of the support guide bar 5 is defined as the shortest circumference on the pool's edge 8 between the position where the dome is set up and the position where it is collapsed, whereby the arches 1 are in the collapsed position placed on or behind the pool's edge 8 . The arches 1 have to be flexible enough to accommodate the pool's radius when in a collapsed position, which is easily achieved if they are made of aluminum tubes.

The hereinabove defined length of the support guide bar 5 provides only that the arches 1 be placed in a collapsed position on or behind the pool's edge 8 and not the whole membrane 2, which forms when the dome is set up in its surface curves terminating in the first and second support bases 3 and 4 that are shorter than the arches 1 . Although, depending on the design of the dome, a very small portion of the membrane 2 in a collapsed position lies on the water, lengthening the support bar 5 for the difference between the length of arch 1 and the shortest curve in membrane 2 surface terminating in the first and second supporting bases 3 and 4 prevent that.

Figure 2:
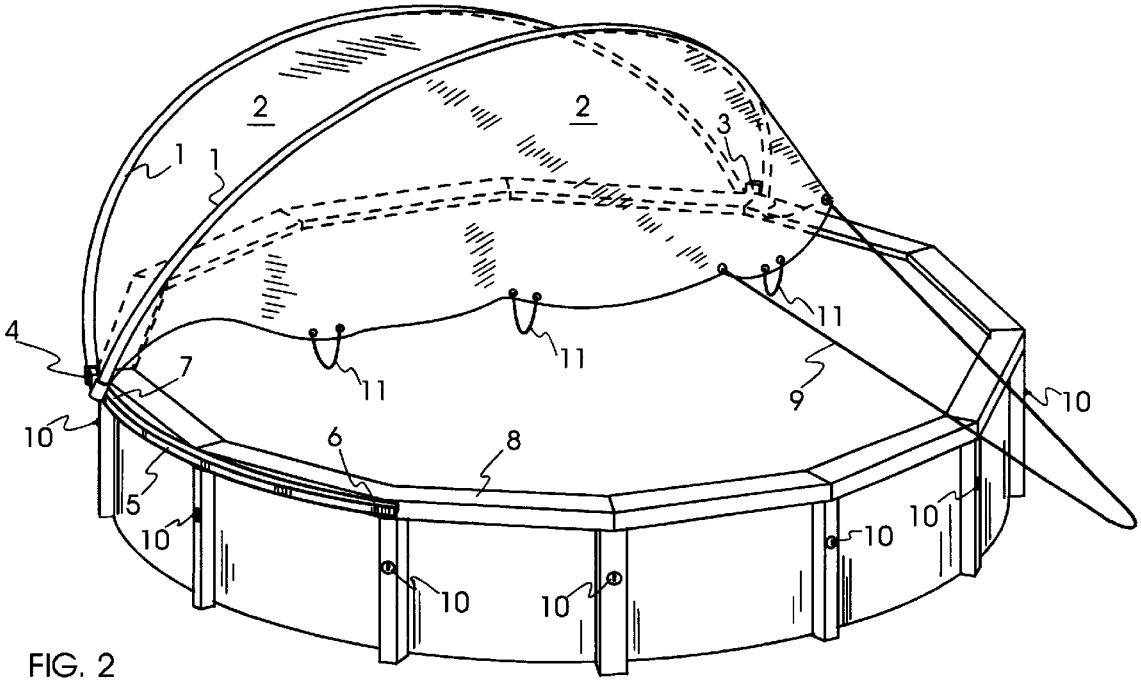
FIG. 2 is a perspective view of a collapsible dome being raised

Thus, to set up the dome, the user simply puts the ends 16 and 17 of the arches 1 into the cups 12, fastens the membrane 2 to the pool's edge 8 with at least one fastener, mounted on the pool's edge 8 between the end 7 of the support guide bar 5 and the first support base 3, to prevent the dome from collapsing on the other side and pulls the lifting rope 9 . Once the structure is raised as illustrated in FIG. 2, the support base 4 to which the structure is attached on one side is pushed from the end 7 of the support guide bar 5 to the beginning 6 of the support guide bar 5 . The erected dome may then be fastened to the ground by means of hook assemblies which include hook cleats 10 fixed to the pool and elastic ropes 11 fixed on both ends to the membrane 2 and hooked over the hook cleats 10.

To effect collapse of the dome the procedure would simply be reversed. Elastic ropes 11 would be removed from the hook cleats 10 except from those, mounted on the pool between the end 7 of the support guide bar 5 and the first support base 3. Those cleats 10, mounted on the pool between the end 7 of the support guide bar 5 and the first support base 3, do not hinder the shifting of the support base 4 to the end 7 of the support guide bar 5. Then the support base 4 would simply be pushed (by another person) to the end 7 of the support guide bar 5 and the lifting rope 9, which maintains balance, would slowly be released to effect the collapse of the structure. In the collapsed position, the arches 1 would lie closely adjacent one above the other on the pool's edge 8 and the membrane 2 would be pulled out of the water and folded above the arches 1.

It should be noted, that when it is desired to remove the dome for winter storage or any other reason, all the elastic ropes 11 should be removed from the hook cleats 10 after collapsing and the ends 16 and 17 of the arches 1 should simply be pulled out of the cups 12.

As shown in FIG. 1, a suitable opening entry 14 may be provided to enable use of the pool when the dome is erected.

Figure 5:
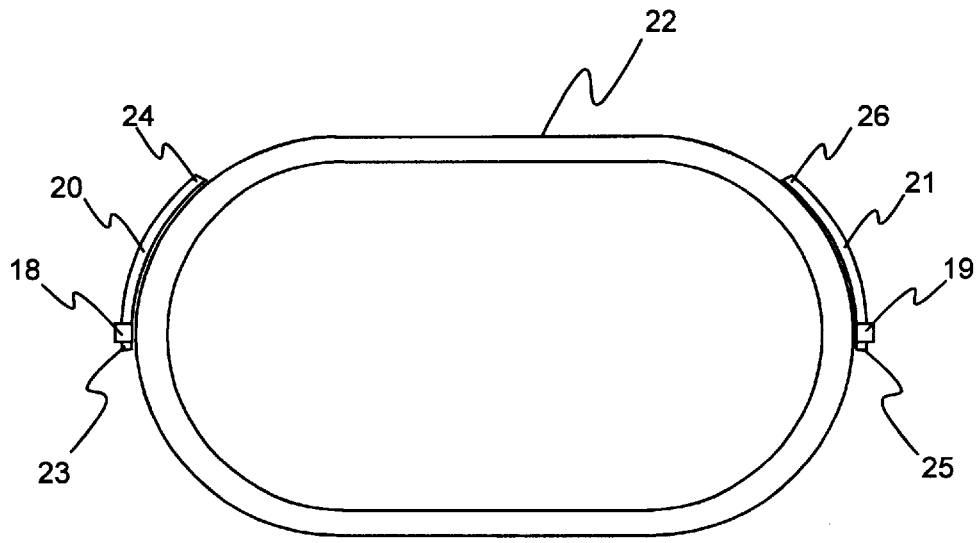
FIG. 5 is a plan view of pool's edge of an oval pool with two support guide bars mounted on it

When the dome is used on pools with shape different than round like oval or rectangular, shifting of both support bases along the pool's edge before the collapsing of the dome is required to assure collapsing of the dome on or behind the pool's edge. In this case the first support base 18 is slidably hung upon a first support guide bar 20 which is mounted on the pool's edge 22 and the second support base 19 is slidably hung upon a second support guide bar 21 which is mounted on the pool's edge 22 opposite the first support guide 20 bar as shown on FIG. 5. Before collapsing, the first support base 18 should be moved from the set up position at the beginning 23 of the first support guide bar 20 to the collapsing position at the end 24 of the first support guide bar 20 and the second support base 19 should be moved from the set up position at the beginning 25 of the second support guide bar 21 to the collapsing position at the end 26 of the second support guide bar 21. This is due to the arches, which, having a larger radius than the pool, would otherwise collapse into the pool instead of onto the pool's edge 22. The length of the first support guide bar 20 and the length of the second support guide bar 21 are simply determined as a difference between the position where the dome is set up and the position where it is collapsed, whereby the dome in the collapsed position is placed on or behind the pool's edge 22.

Figure 6:
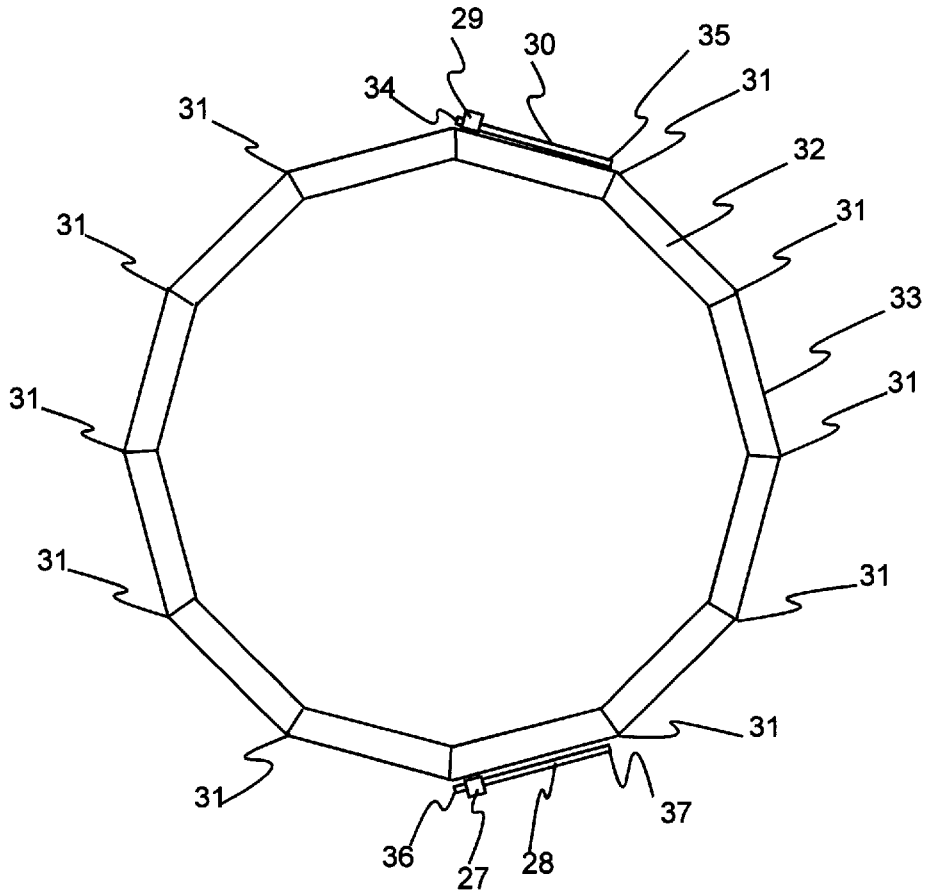
FIG. 6 is a plan view of pool's edge of a round pool with two support guide bars mounted on it

As shown on FIG. 6, to avoid bending of support guide bar 30 around a comer 31, shifting of first support base 29 along the first support guide bar 30, which is mounted on the pool's edge 33, from the set up position at the beginning 34 of the first support guide bar 30 to the collapsing position at the end 35 of the first support guide bar 30 and of second support base 27 along the second support guide bar 28, which is mounted on the pool's edge 33 opposite the first support guide bar 30, from the set up position at the beginning 36 of the second support guide bar 28 to the collapsing position at the end 37 of the second support guide bar 28 before collapsing of the dome is also recommended by those round shaped pools, whose pool's edge 33 consist of several linear segments 32 terminating in corners 31 and the required length of the support guide bar exceeds the length of one linear segment 32.

Although the arches 1 have been shown as being arcuate in shape, it will be obvious to those knowledgeable in the art that this is not a necessary requirement and that the shape may be varied in order to obtain a particular desired shape of the collapsible structure. Thus, it can be seen that the present invention provides a means by which the height of a lightweight, arch-supported, collapsible dome which is designed to cover round shaped pools and also others, and which in a collapsed position does not hinder the water surface, can be reduced regardless of the size of the pool being covered. It also can be seen that the present invention provides a simple pivotable attachment and detachment of the two-arch collapsible dome to and from the pool's edge.

I claim:

1. A collapsible dome comprising a support guide bar mounted on the edge of a pool, a first support base mounted on said edge of said pool opposite said support guide bar on the opposite side of said pool, a second support base slidably hung upon said support guide bar, said support guide bar allowing movement of said second support base along said support guide bar to decrease or increase the distance measured around said pool edge between said first support base and said second support base, at least two arches, each of said arches having a first end and a second end, said first end pivotably attached to said first support base and said second end pivotably attached to said second support base, each of said arches being movable between a collapsed position and an inclined position, a flexible membrane attached to each of said arches, said flexible membrane spanning the area between said arches themselves and between the said arches and said pool edge, when said arches are inclined to form said collapsible dome.

2. A collapsible dome according to claim 1, wherein said flexible membrane has a door means.

3. A collapsible dome according to claim 1, wherein a first arch of said at least two arches and a second arch of said at least two arches having a first end and a second end, said first end of said first arch attached by a slip joint assembly to a first cup, said first cup bound by a cord to said first support base, said first end of said second arch attached by a slip joint assembly to a second cup, said second cup bound by a cord to said first support base, said second end of said first arch attached by a slip joint assembly to a third cup, said third cup bound by a cord to said second support base, said second end of said second arch attached by a slip joint assembly to a forth cup, said forth cup bound by a cord to said second support base, said first arch and said second arch being movable between a collapsed position and an inclined position.

4. A collapsible dome comprising a first support guide bar mounted on the edge of a pool, a second support guide bar mounted on said edge of said pool opposite said first support guide bar on the opposite side of said pool, a first support base slidably hung upon said first support guide bar, said first support guide bar allowing movement of said first support base along said first support guide bar to decrease or increase the distance measured around said pool edge between said first support base and said second support guide bar, a second support base slidably hung upon said second support guide bar, said second support guide bar allowing movement of said second support base along said second support guide bar to decrease or increase the distance measured around said pool edge between said second support base and said first support guide bar, at least two arches, each of said arches having a first end and a second end, said first end pivotably attached to said first support base and said second end pivotably attached to said second support base, each of said arches being movable between a collapsed position and an inclined position, a flexible membrane attached to each of said arches, said flexible membrane spanning the area between said arches themselves and between the said arches and said pool edge, when said arches are inclined to form said collapsible dome.

5. A collapsible dome according to claim 1, wherein said flexible membrane has a door means.

6. A collapsible dome according to claim 1, wherein a first arch of said at least two arches and a second arch of said at least two arches having a first end and a second end, said first end of said first arch attached by a slip joint assembly to a first cup, said first cup bound by a cord to said first support base, said first end of said second arch attached by a slip joint assembly to a second cup, said second cup bound by a cord to said first support base, said second end of said first arch attached by a slip joint assembly to a third cup, said third cup bound by a cord to slip joint assembly to a forth cup, said forth cup bound by a cord to said second support base, said first arch and said second arch being movable between a collapsed position and an inclined position.

7. A collapsible dome according to claim 5, wherein said flexible membrane has a door means.

8. A collapsible dome comprising a first support base mounted on the edge of a pool, a second support base mounted on said edge of said pool opposite said first support base on the opposite side of said pool, a first arch and a second arch, said first arch and said second arch having a first end and a second end, said first end of said first arch attached by a slip joint assembly to a first cup, said first cup bound by a cord to said first support base, said first end of said second arch attached by a slip joint assembly to a second cup, said second cup bound by a cord to said first support base, said second end of said first arch attached by a slip joint assembly to a third cup, said third cup bound by a cord to said second support base, said second end of said second arch attached by a slip joint assembly to a forth cup, said forth cup bound by a cord to said second support base, said first arch and said second arch being movable between a collapsed position and an inclined position, a flexible membrane attached to each of said arches, said flexible membrane spanning the area between said arches and between said arches and said pool edge, when said arches are inclined to form said collapsible dome.

* * * * *